US005638690A

United States Patent [19]

Berglöf

[11] Patent Number: 5,638,690

[45] Date of Patent: Jun. 17, 1997

[54] METHOD AND APPARATUS FOR THE CLEANSING OF OIL FROM REFRIGERATING MACHINES AND HEAT PUMPS

[75] Inventor: Klas Berglöf, Nacka, Sweden

[73] Assignee: AKA Industriprodukter Kyla AB, Solna, Sweden

[21] Appl. No.: 491,926

[22] PCT Filed: Jan. 29, 1993

[86] PCT No.: PCT/SE93/00067

§ 371 Date: Jul. 13, 1995

§ 102(e) Date: Jul. 13, 1995

[87] PCT Pub. No.: WO94/17348

PCT Pub. Date: Aug. 4, 1994

[51] Int. Cl.[6] ..... F25B 43/02

[52] U.S. Cl. ..... 62/84; 62/468; 62/475

[58] Field of Search ..... 62/84, 85, 292, 62/468, 470, 475

[56] References Cited

U.S. PATENT DOCUMENTS 4,441,330 4/1984 Lower et al. ..... 62/292

4,476,688 10/1984 Goddard ..... 62/292

4,934,490 6/1990 Sapp ..... 62/303

FOREIGN PATENT DOCUMENTS

92/16801 10/1992 WIPO .

*Primary Examiner*—John M. Sollecito

*Attorney, Agent, or Firm*—Sughrue, Mion, Zinn, Macpeak & Seas

[57] ABSTRACT

A system for removing lubricating oil from a refrigeration system the lubricating oil being used together with a first type of refrigerant in said system and replacing this oil with an oil which is compatible with a second type of refrigerant, to convert the refrigerating system or heat pump system from a system which operates with said second type of refrigerant, by flushing the system to be cleansed of oil with a circulating refrigerant of the first type. The refrigerant is capable of dissolving the oil and has a higher density than said oil so as to be able to lift and entrain the oil during the flushing process. The refrigerant is circulated through the entire refrigeration system and through an external apparatus used to circulate the refrigerant.

9 Claims, 3 Drawing Sheets

Figure 1:
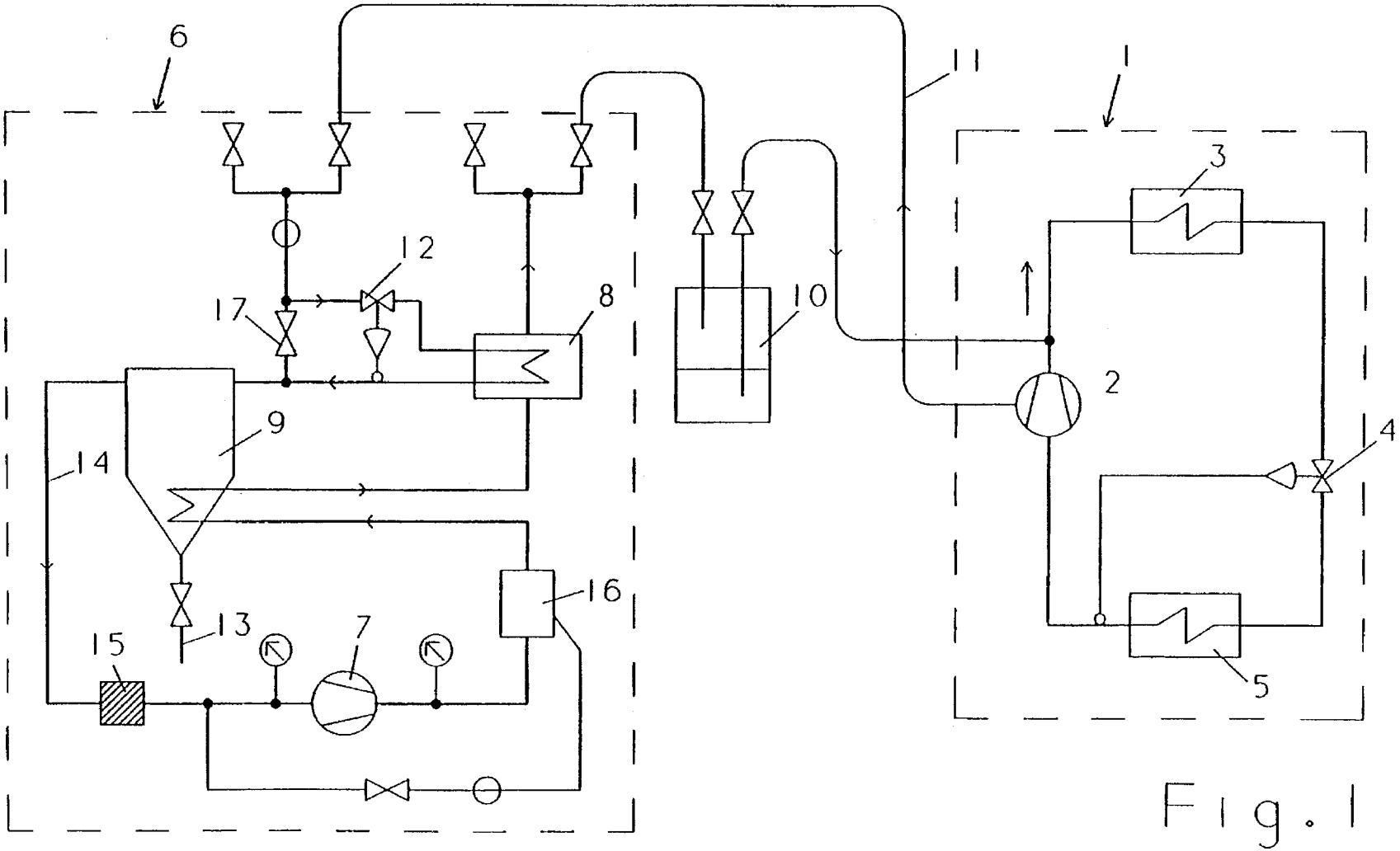

METHOD AND APPARATUS FOR THE CLEANSING OF OIL FROM REFRIGERATING MACHINES AND HEAT PUMPS

The present invention is concerned with the conversion of a refrigerating machine or a heat pump from operation with a first type of refrigerant to operation with a second type of refrigerant and relates to a method of removing the lubricating oil that is contained by the system and used together with the first type of refrigerant, and replacing this lubricating oil with another lubricating oil that is compatible with the second type of refrigerant. The invention also relates to an arrangement for use when carrying out the method.

Because the refrigerant typically used in refrigerating machines and heat pumps is comprised of CFC-compounds (fully halogenated chlorofluoro-substituted hydrocarbons) which have a deleterious effect on the atmospheric ozone layer, drastic measures have been taken to eliminate the use of such compounds. Since the replacement HFC-compounds (hydrofluoro carbons) are chlorine-free, they require the use of lubricants other than the mineral oils or alkylbenzene oils used today. The lubricating oils are primarily used to lubricate and to seal the compressors of the refrigerating systems.

The oils mainly used together with chlorine-free refrigerants are polyester oils. Since residues of mineral oil in the refigerating system can result in a number of problems, a limit of 1% has been placed on the amount of mineral oil that is allowed to remain in the system. However, since oil is dispersed throughout the whole of the system, only some of this oil can be drained from the system through the compressor drainage hole; it will be observed that not all compressors are equipped with a drainage hole. When circumstances are favourable, about 80–90% of the oil can be removed from the system without difficulty. At least 3–4 oil changes are normally required to reach a residual mineral oil content of 1%. These oil changes must be made while running the system for a given length of time between each change, so that mineral oil is able to mix with the ester oil. The cost entailed by such a process is very high, since it requires several visits by a service technician. Oil consumption also becomes relatively high. The method also presumes that the compressor is functional. If a compressor malfunctions or breaks down, it is not possible to terminate the system cleansing or purging process until a new compressor has been fitted, whereby this new compressor will also be "contaminated" with the mineral oil. The compressors are to a very large part completely hermetic and are soldered in the circuit, which means that solder must be removed in order to allow oil to be drained-off.

Some manufacturers of refrigerating machines and heat pumps recommend replacement of the compressor when converting from CFC to HFC. This requires, however, dismantling the system and buying a new compressor.

The main object of the present invention is to provide a method and an arrangement which will enable existing refrigerating machines and heat pumps to be cleansed or purged of oil in a simple and effective manner, without needing to dismantle the refrigerating machine or heat pump. Another object is to enable the refrigerating machine or the heat pump to be cleansed of oil quickly and at low cost.

The invention is based on the realization that because the refrigerant is able to dissolve oil and because the density of the refrigerant is higher than the density of the oil, whereby the refrigerant is able to lift and transport the oil in the system, the refrigerant can also be used to cleanse the system of oil.

When tapping refrigerant from refrigerant carrying systems, for instance when servicing the systems, it has earlier been normal practice to separate the oil from the mixture of refrigerant and oil drained from the system. In this case, however, the oil removed is restricted to the amount of oil that accompanies the mixture drained from the system. Oil which is located beneath the tapping level will therefore be left in the system.

When practicing the present invention, essentially all oil is removed, by flushing the system continuously with circulating refrigerant from which oil is separated prior to recirculating the refrigerant, and by delivering refrigerant in an amount such that all oil in the system will be lifted to a requisite level for transportation out of the system.

According to the present invention, a method of the kind defined in the first paragraph of the introduction is mainly characterized by flushing the system to be cleansed of oil with a circulating refrigerant of the first kind, which is able to dissolve the oil and to lift and entrain the oil because of its higher density; with the aid of external apparatus connected to the system, circulating refrigerant through the whole of said system or a selected part thereof and through said external apparatus; vapourizing the refrigerant/oil mixture leaving the system in the external apparatus so as to extract the oil from the refrigerant prior to returning said refrigerant to the system; and by maintaining circulation of refrigerant through the system and through said external apparatus until the system has been cleansed of oil to the extent desired.

The inventive method thus enables the amount of mineral oil that remains in the system to be brought to a desired level in one single stage, without needing to dismantle the system. If necessary, in the case of larger systems, the procedure can be carried out in two stages which are separated by a given system running time.

It is preferred to use refrigerant in a quantity such that the level of the different components in the system will be sufficient to lift remaining oil to a level which will enable the oil to be carried away by the refrigerant. This will enable awkwardly placed compressors and compressors which lack a draining plug to be effectively cleansed of oil.

The external apparatus is suitably connected to existing service points in the system, therewith enabling the cleansing process to be carried out without dismantling or interfering with the system. The refrigerant is preferably maintained at least partially in a liquid phase during its passage through the system.

The main characteristic features of an arrangement for use when carrying out the inventive method are made apparent in the following claims.

Figure 2:
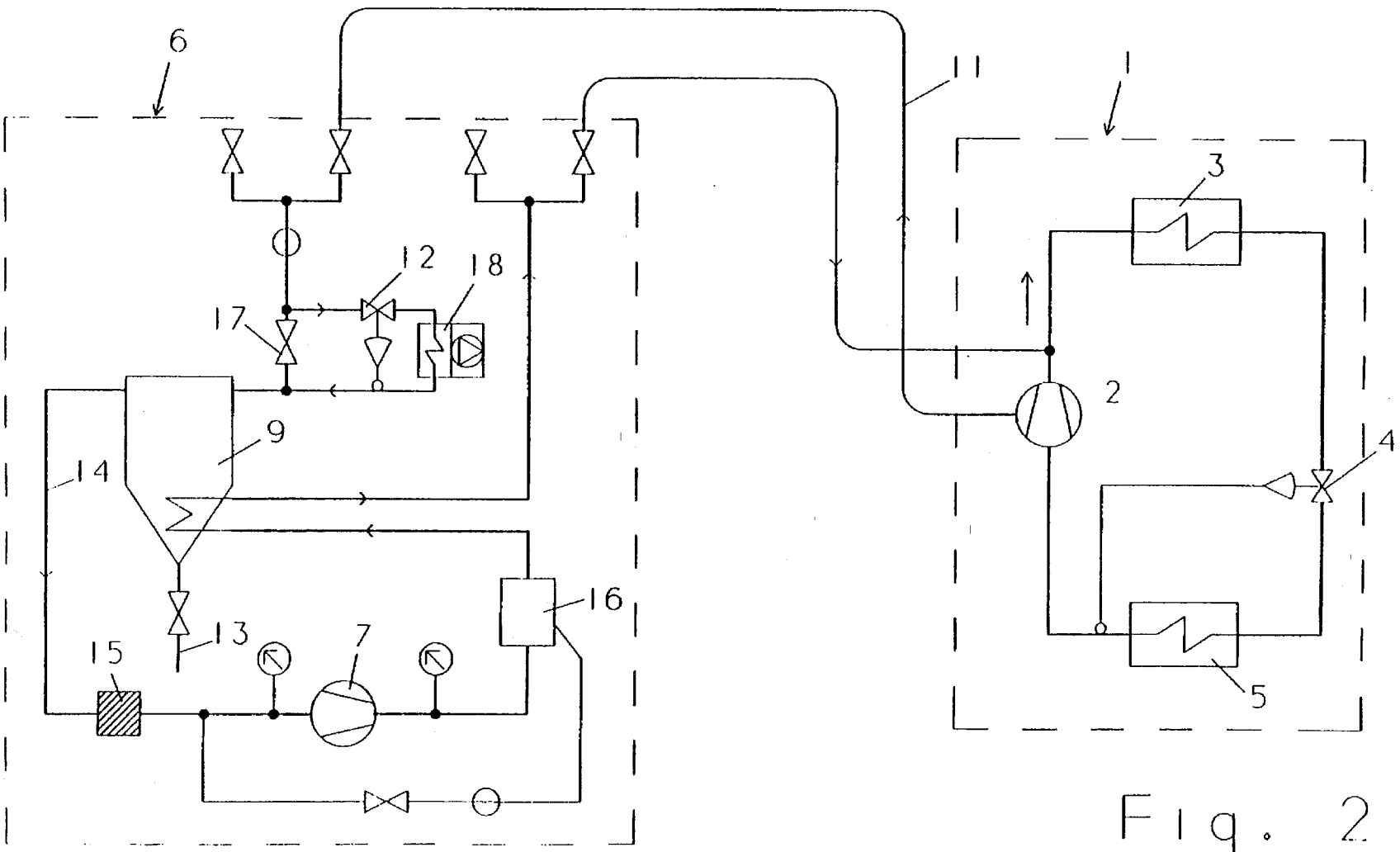
Figure 3:
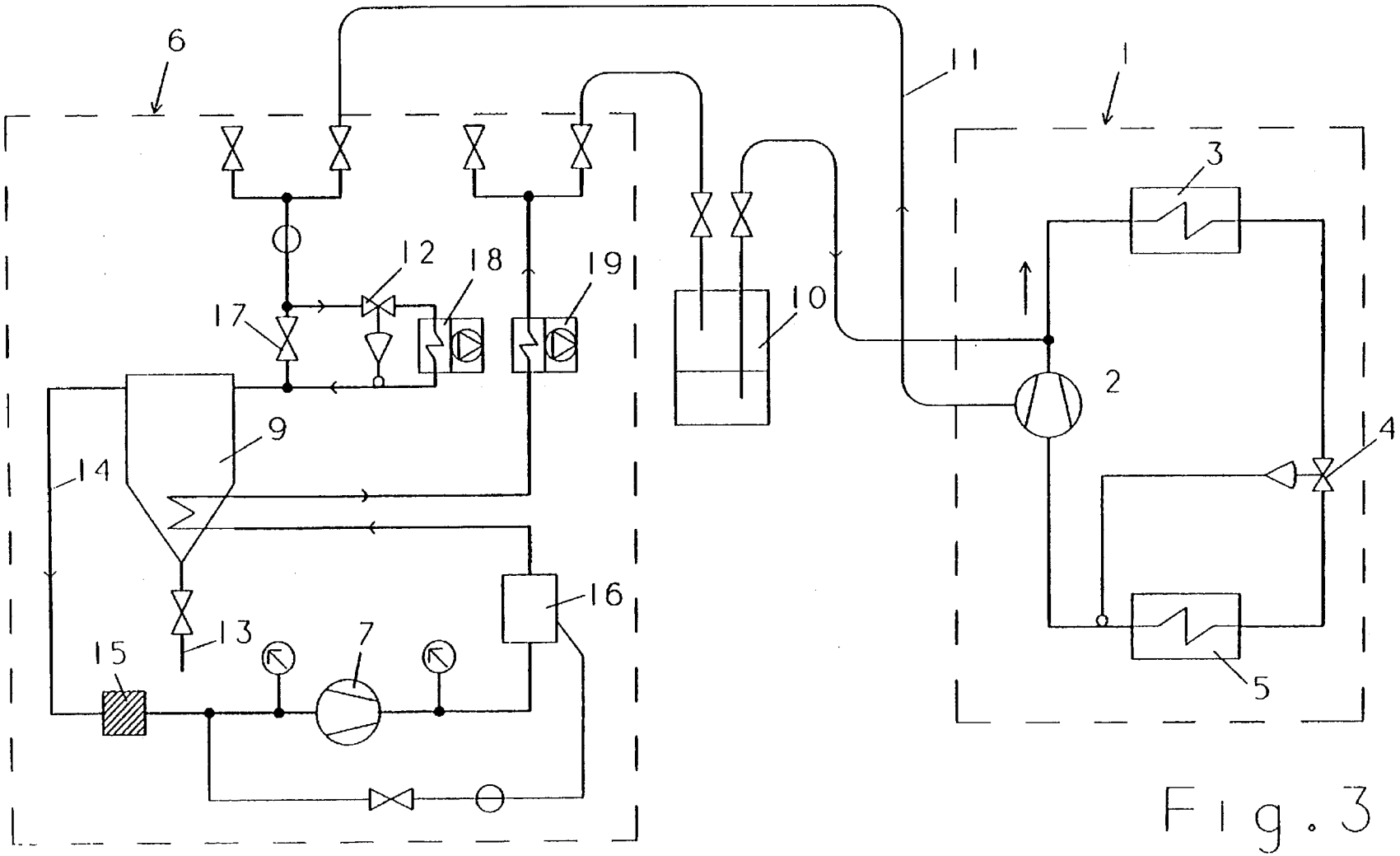

The invention will now be described in more detail with reference to the accompanying drawings, in which FIGS. 1–3 illustrate selected exemplifying embodiments of external apparatus according to the invention connected to a refrigerating machine, shown schematically in the drawings.

FIG. 1 illustrates generally a conventional refrigerating machine 1 which comprises a compressor 2, a condensor 3, an expansion valve 4 and at least one evaporator 5. A refrigerant, hitherto normally a CFC or HCFC type refrigerant, circulates in the refrigerating circuit when the circuit is at work. As illustrated, the valve 4 is controlled by the temperature prevailing downstream of the evaporator 5, so as to ensure that all refrigerant is evaporated in the evaporator prior to entering the compressor 2. This is the normal, conventional mode of operation of a refrigerating system and will not therefore be described in more detail here. It will be understood that the system may also operate as a heat pump, in addition to operating as a refrigerating machine.

When converting the refrigerating machine for work with a different type of refrigerant, for instance a HFC-refrigerant, which is to be preferred from an environmental aspect, the oil that was used as a lubricant and as a sealing agent in the compressor 2 and which is dispersed throughout the whole of the system must be removed from the system. An HFC-type refrigerant contains no chlorine and therefore requires a different type of lubricant to the mineral oils and alkylbenzene oils normally used. The oils mainly used together with the chlorine-free refrigerants are polyester oils and less than 1% of the mineral oil earlier used may remain when transferring to this type of refrigerant.

Accordingly, an external apparatus, generally referenced 6, is connected to two connection points of the refrigerating machine 1 in accordance with the invention. These connection points may, for instance, have the form of an oil drainage hole in the compressor 2, and a typical service outlet on the high pressure side of the compressor. The external apparatus functions to circulate refrigerant of the earlier used kind through the now passive refrigerating machine and therewith dissolve and/or lift the oil, which has a lower density than the refrigerant, and to carry the oil out of the system.

To this end, the external apparatus 6 includes a compressor 7 which generates a pressure difference in the system, an evaporator 8 and an oil separator 9. A refrigerant container 10 is connected between the refrigerating machine 1 and the external apparatus 6.

When the compressor 7 is working, refrigerant will be sucked from the compressor 2 of the refrigerating machine, through a pipe 11 and through a controlled expansion valve 12, from where it passes into the evaporator 8. The valve 12 controls the flow of the refrigerant and oil mixture to the evaporator 8 in accordance with the temperature prevailing downstream of the evaporator, so as to maintain complete vaporization of the mixture delivered to the evaporator. The vaporized mixture is delivered to an oil separator 9, in which oil is separated from the mixture and discharged through a pipe 13, while the cleansed refrigerant is delivered in a gaseous state to the compressor 7, through a pipe 14 and a filter 15.

The reference 16 identifies an oil separator which extracts oil slung from the compressor 7 and recycles this oil back to the inlet side of the compressor.

The hot gas compressed by the compressor 7 can be used as supplementary heat source in the oil separator 9 and for the vaporizing process in the evaporator 8. At least part of the hot gas will condense in the evaporator, before being delivered to the refrigerant container 10.

The aforedescribed external apparatus 6 functions to circulate refrigerant through the refrigerating machine 1, so as to entrain remaining mineral oil, this entrained oil being separated from the refrigerant in the external apparatus 6, whereafter the cleansed refrigerant is returned to the refrigerating machine via the refrigerant container 10, which functions as a buffer tank. This recycling of the refrigerant while continuously extracting oil therefrom is continued until the desired low content of residual mineral oil in the refrigerating machine 1 has been achieved. In the case of large refrigerating machines, it may be necessary to divide the process into two stages while running the machine between said stages.

The process is carried out under pressure conditions such that at least a part of the refrigerant will be in a liquid phase during its passage through the machine. The only energy emitted to the surroundings is that which is generated by the temperature of the refrigerant in the system rising to above ambient temperature. The system will thus reach a state of balance. It may be necessary to deliver heat to the sensors associated with the expansion valve 4, in order to ensure that the valve is fully open.

The external apparatus can be connected to existing service connections on the refrigerating machine, thereby obviating the need to dismantle any component from the machine or to manipulate the system in any other way. Since the compressor outlet is seldom located at the lowest point of the compressor, it is normally necessary to raise the level of the oil/refrigerant mixture in the system, so that a level is reached in which all oil is lifted up to a level which enables it to be removed from the compressor.

When the desired residual mineral oil content has been reached, the refrigerating machine is emptied of refrigerant. To this end, there is provided a valve 17 which bypasses the expansion valve 12 and the evaporator 8, so as to avoid an unnecessary drop in pressure and excessive heating of the gas delivered to the compressor 7, as this would shorten the useful life of the compressor. The compressor can then be filled with an oil which is compatible to the new refrigerant with which the refrigerating machine is filled.

FIG. 2 illustrates a modified embodiment of the external apparatus described with reference to FIG. 1. Those parts which find direct correspondence in FIG. 1 have been identified with the same reference signs as those used in said Figure. The only difference between the apparatus illustrated in FIG. 1 and the apparatus illustrated in FIG. 2 is that the FIG. 2 embodiment does not include a combined refrigerant evaporator and condensor downstream of the compressor 7. Instead, the refrigerant is delivered to the passive refrigerating machine in an essentially gaseous state. Normally, the intermediate refrigerant container can also be omitted. In this regard, the gas condenses upon contact with the colder surfaces in the refrigerating machine and initially essentially in the condensor 3. As the refrigerating machine heats up, the liquid front moves forward in the circuit and entrains the residual oil present therein.

The gas/liquid mixture obtained from the refrigerating machine is vaporized in a separate air-heated or water-heated evaporator 18 in the external apparatus 6. In other respects, the apparatus operates in the same manner as the earlier described apparatus. One advantage with the apparatus illustrated in FIG. 2 is that it enables a reduction in the volume of refrigerant required, which is highly beneficial in large refrigerating systems in particular.

The embodiments illustrated in FIGS. 1 and 2 can also be combined, and an optimal function can be obtained by switching between driving of the respective apparatus according to FIGS. 1 and 2. The drive between these apparatus can be switched manually or automatically, wherein, for instance, the temperature of the refrigerating machine can first be raised by delivering gaseous refrigerant directly to the machine, and thereafter deliver a liquid pulse.

FIG. 3 illustrates a unit which can operate in accordance with either one of the two aforedescribed methods and which comprises two separate heat exchangers 18 and 19 respectively, both of which operate with air or water. In this regard, the unit 18 functions as an evaporator in accordance with the FIG. 2 embodiment, while the unit 19 functions as a condensor. As will be understood by those skilled in this art, other intermediate forms are conceivable.

The aforedescribed exemplifying embodiments can also be varied in several respects within the scope of the following claims. For instance, the points at which the external apparatus is connected to the refrigerating machine or the heat pump can be chosen from case to case in accordance with the possibilities that are available. The external apparatus can also be connected so that only part of the system will be flushed on each occasion. The system may also be flushed in different directions at different time periods.

In some cases, the illustrated container 10, which functions as a refrigerant buffer tank, can be omitted also in the external apparatus illustrated in FIG. 1. Additional heating of the oil separator 9 may also be omitted. The entire system is closed and refrigerant cannot therefore leak to atmosphere during the course of the process, and the external apparatus may also be used for final, closed drainage of refrigerant.

I claim:

1. A method for removing lubricating oil from a refrigerating system or heat pump system, the lubricating oil being used together with a first type of refrigerant in said system and, replacing this oil with an oil which is compatible with a second type of refrigerant, to convert the refrigerating system or heat pump system from a system which operates with said second type of refrigerant, said method comprising the steps of:

flushing the system to be cleansed of oil with a circulating refrigerant of said first type, wherein said refrigerant is capable of dissolving the oil and has a higher density than said oil so as to be able to lift and entrain the oil during the flushing process;

circulating the refrigerant through the entire system and through an external apparatus used to circulate said refrigerant;

using the refrigerant in an amount which will ensure that the level of refrigerant in various system components will be sufficient to lift residual oil to a level to enable said oil to be carried away by the refrigerant;

evaporating, in said external apparatus, the mixture of refrigerant and oil leaving the system and separating the oil from the refrigerant prior to returning said refrigerant to the system; and maintaining circulation of the refrigerant through the system and the external apparatus until the system has been cleansed of oil to the desired extent.

2. A method according to claim 1, further comprising the step of causing at least part of the separated refrigerant, produced in the external apparatus, to condense at a location corresponding to at least of one: prior to return of the separated refrigerant to the system and upon entry of the separated refrigerant to a first part of said system, and wherein during said circulating step, the refrigerant is maintained at least partially in a liquid phase during its passage through the system.

3. A method according to claim 1, characterized by connecting the external apparatus to existing system service points; and by cleansing said system without dismantling any part thereof.

4. An arrangement for removing lubricating oil from a refrigerating system or heat pump system, the lubricating oil being used together with a first type of refrigerant in said system and replacing this oil with an oil which is compatible with a second type of refrigerant to convert the refrigerating system or heat pump system from a system which operates with said first type of refrigerant to a system which operates with said second type of refrigerant, said arrangement including:

an external apparatus comprising means for connecting said apparatus to the system to be cleansed;

means for flushing the system with circulating refrigerant of said first type, said refrigerant having the ability to dissolve the oil and also having a higher density than said oil so as to be able to lift and entrain the oil, said flushing means being adapted to circulate the refrigerant through the entire system and the external apparatus; and means for evaporating a mixture of refrigerant and oil leaving the system and for separating the oil from the refrigerant prior to returning said refrigerant to the system.

5. An arrangement according to claim 4, wherein said external apparatus further includes:

means for at least partially condensing the separated refrigerant prior to returning the refrigerant to the system; and a compressor to maintain a pressure in the system such that the refrigerant will be maintained at least partially in a liquid phase during its passage through the system.

6. An arrangement according to claim 5, wherein the means for evaporating the refrigerant includes an evaporator which receives heat from gas which is compressed in said compressor and which is delivered to the evaporator, the delivered gas becoming at least partially condensed.

7. An arrangement according to claim 6, wherein the external apparatus includes a regulating valve, said valve being connected upstream of the evaporator to regulate the flow of medium to the evaporator, so as to obtain complete evaporation of the refrigerant and oil mixture delivered to the evaporator from the system.

8. An arrangement according to claim 7, wherein the means for separating oil from the refrigerant comprises an oil separator connected downstream of the evaporator for separating oil from the gas mixture prior to its delivery to the compressor.

9. An arrangement according to claim 4, further including a closed refrigerant container which is connected between the external apparatus and the system connecting point which is used as an inlet.

* * * * *